US009855479B2

(12) United States Patent
Cameron et al.

(10) Patent No.: US 9,855,479 B2
(45) Date of Patent: Jan. 2, 2018

(54) SWIMMING SYSTEM CURRENT GENERATOR

(71) Applicant: Watkins Manufacturing Corporation, Vista, CA (US)

(72) Inventors: Hayden Cameron, Philadelphia, PA (US); James Murdock, Wayne, PA (US)

(73) Assignee: Watkins Manufacturing Corporation, Vista, CA (US)

( * ) Notice: Subject to any disclaimer, the term of this patent is extended or adjusted under 35 U.S.C. 154(b) by 19 days.

(21) Appl. No.: 15/010,017

(22) Filed: Jan. 29, 2016

(65) Prior Publication Data

US 2017/0216697 A1 Aug. 3, 2017

(51) Int. Cl.

| | |
|---|---|
| ***E04H 4/00*** | (2006.01) |
| ***A63B 69/12*** | (2006.01) |
| ***E04H 4/12*** | (2006.01) |
| ***F04D 1/00*** | (2006.01) |
| ***F04D 13/06*** | (2006.01) |
| ***F04D 13/12*** | (2006.01) |
| ***F04F 5/46*** | (2006.01) |
| ***F04F 5/12*** | (2006.01) |

(52) U.S. Cl.

CPC ..... *A63B 69/125* (2013.01); *E04H 4/12* (2013.01); *F04D 1/00* (2013.01); *F04D 13/06* (2013.01); *F04D 13/12* (2013.01); *F04F 5/12* (2013.01); *F04F 5/46* (2013.01)

(58) Field of Classification Search

CPC ..... A63B 69/125
USPC ..... 4/488, 492
See application file for complete search history.

(56) References Cited

U.S. PATENT DOCUMENTS

| | | | |
|---|---|---|---|
| 3,534,413 | A | 10/1970 | Plasseraud |
| 4,001,899 | A | 1/1977 | Mathis |
| 4,352,215 | A | 10/1982 | Laing |
| 4,561,133 | A | 12/1985 | Laing |
| 4,665,572 | A | 5/1987 | Davidson et al. |
| 4,907,304 | A | 3/1990 | Davidson et al. |
| 4,941,217 | A | 7/1990 | Tobias et al. |

(Continued)

FOREIGN PATENT DOCUMENTS

| | | |
|---|---|---|
| AT | 11238 U1 | 7/2010 |
| DE | 2401040 | 7/1975 |

(Continued)

OTHER PUBLICATIONS

European Search Report; Appl No. 1620621.4-1658 dated May 11, 2017; 7 Pages.

*Primary Examiner* — Lori Baker
(74) *Attorney, Agent, or Firm* — Reising Ethington, P.C.

(57) ABSTRACT

A current generator for a swimming system may include multiple entrainment pumps that discharge a flow of water into a pool. The entrainment pumps may each have a nozzle, a venturi and an entrainment inlet. In use, the flow of water from the nozzle into the venturi causes water at the entrainment inlet to flow into the venturi along with water from the nozzle. Each entrainment pump is arranged such that the fluid that flows out of the venturi passage is directed within a main passage, and the flow from multiple venturis may be combined and may be directed at least partially against the force of gravity before that fluid is directed out of the main passage outlet and into the pool. In at least some implementations, the fluid flows for at least one foot between the venturi and the main passage outlet.

22 Claims, 4 Drawing Sheets

(56) References Cited

U.S. PATENT DOCUMENTS

| | | | |
|---|---|---|---|
| 5,044,021 | A | 9/1991 | Murdock |
| 5,211,508 | A | 5/1993 | Makino |
| 6,003,166 | A | 12/1999 | Hald et al. |
| 7,311,821 | B2 | 12/2007 | Queirel |
| 7,526,820 | B2 | 5/2009 | Murdock et al. |
| 8,322,908 | B1 | 12/2012 | Hartmann |
| D708,346 | S | 7/2014 | Harder |
| 9,038,208 | B2 | 5/2015 | Ferriss et al. |
| 2007/0039092 | A1 | 2/2007 | Murdock et al. |
| 2007/0039876 | A1 | 2/2007 | Gori |
| 2008/0016610 | A1 | 1/2008 | Kuo et al. |
| 2008/0148470 | A1 | 6/2008 | Ferriss et al. |
| 2009/0064404 | A1 | 3/2009 | Frei |
| 2010/0269251 | A1 | 10/2010 | DeMotts |
| 2011/0004993 | A1 | 1/2011 | Frei |
| 2011/0271436 | A1 | 11/2011 | Kite |
| 2015/0074895 | A1 | 3/2015 | Harder |

FOREIGN PATENT DOCUMENTS

| | | |
|---|---|---|
| EP | 0313242 | 4/1989 |
| EP | 0472976 | 3/1992 |
| FR | 2716913 | 9/1995 |
| JP | 2002263234 | 9/2002 |
| WO | 2005066436 | 7/2005 |

SWIMMING SYSTEM CURRENT GENERATOR

TECHNICAL FIELD

The present disclosure relates generally to a counter current swimming system and more particularly to a current generator for a counter current swimming system.

BACKGROUND

Swim spas or pools may include a mechanism to generate a current or water flow within the pool and against which a person may swim. These systems are called counter current swimming systems because the water flow direction is against or counter to the direction in which the person swims. The current generated offsets the forward progress of the swimmer and the swimmer may remain generally in place while swimming. This permits exercise in even smaller spas or pools where swimming without a current would be impractical.

Existing swim spas use multiple electrically powered pumps to pump water through jets oriented horizontally in the spa and aimed at the swimmer. The jets provide discrete streams of water at high pressure that impinge upon the swimmer who is generally within one or two feet of the jets. This may be uncomfortable, and if the swimmer does not remain precisely aligned with the jets, the force on the swimmer is decreased and the swimmer is not held in place.

SUMMARY

In at least some implementations, a current generator for a swimming system having a main volume for a swimmer and a main passage in which water flows from the current generator to an outlet of the main passage that leads to the main volume includes multiple entrainment pumps arranged to discharge a flow of liquid (e.g. water) into a pool. The entrainment pumps may each have a nozzle, a venturi and an entrainment inlet. The nozzles have a nozzle inlet communicating with and receiving pressurized liquid from a liquid source and a nozzle outlet. The venturi has a passage aligned with the nozzle and through which liquid discharged from the nozzle outlet flows, and the venturi has a venturi outlet from which fluid flows out of the venturi passage. The entrainment inlet is open to the area outboard of the nozzle and communicates with the venturi passage. In use, the flow of liquid from the nozzle outlet into the venturi creates a pressure drop at the entrainment inlet and fluid in the area of the entrainment inlet is drawn through the entrainment inlet and entrained with the liquid in the venturi to flow through the venturi and out of the venturi outlet. Each entrainment pump is arranged such that the fluid that flows out of the venturi passage is directed within the main passage at least partially against the force of gravity before that fluid is directed out of the main passage outlet and into the main volume. The vertical component of the fluid flow provides additional space in which the flows from the venturi outlets may mix into a more uniform output, without consuming significant space within the main volume of a swim spa.

In at least some implementations, a swimming system includes a pool in which a supply of liquid is maintained, a main passage communicated with the supply of liquid, a primary pump, and a plurality of entrainment pumps. The entrainment pumps may each have a nozzle, a venturi and an entrainment inlet. The nozzles have a nozzle inlet communicating with and receiving pressurized liquid from the primary pump and a nozzle outlet. The venturi has a passage aligned with the nozzle and through which liquid discharged from the nozzle outlet flows, and the venturi has a venturi outlet from which fluid flows out of the venturi passage and into the main passage. The entrainment inlet is open to the area outboard of the nozzle and communicates with the venturi passage. Each entrainment pump is arranged so that fluid that flows out of the venturi passage is directed within the main passage at least partially against the force of gravity and the direction of the fluid is changed within the main passage before the fluid exits the main passage through the main passage outlet. In some implementations, the venturi outlets may be at least one foot from the main passage outlet, the venturi outlets may be at least one foot below the water level within the main volume and/or the entrainment inlets of at least two entrainment pumps may be provided at different heights. Still other implementations are set forth and others will be apparent form the disclosure provided herein.

BRIEF DESCRIPTION OF THE DRAWINGS

The following detailed description of preferred embodiments and best mode will be set forth with reference to the accompanying drawings, in which.

DETAILED DESCRIPTION OF PRESENTLY PREFERRED EMBODIMENTS

Figure 1:
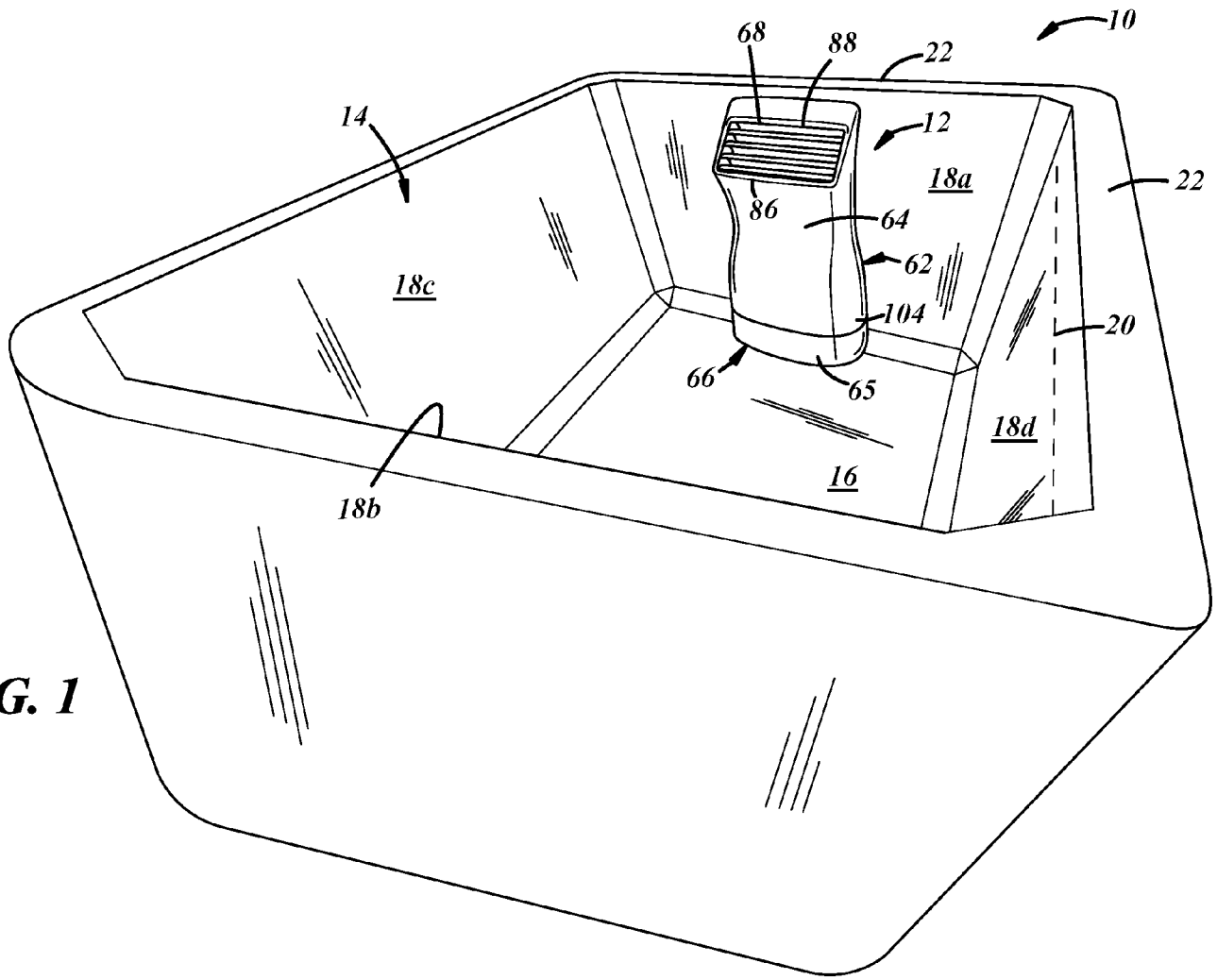
FIG. 1 is a perspective view of a swim spa including one implementation of a current generator.
Figure 2:
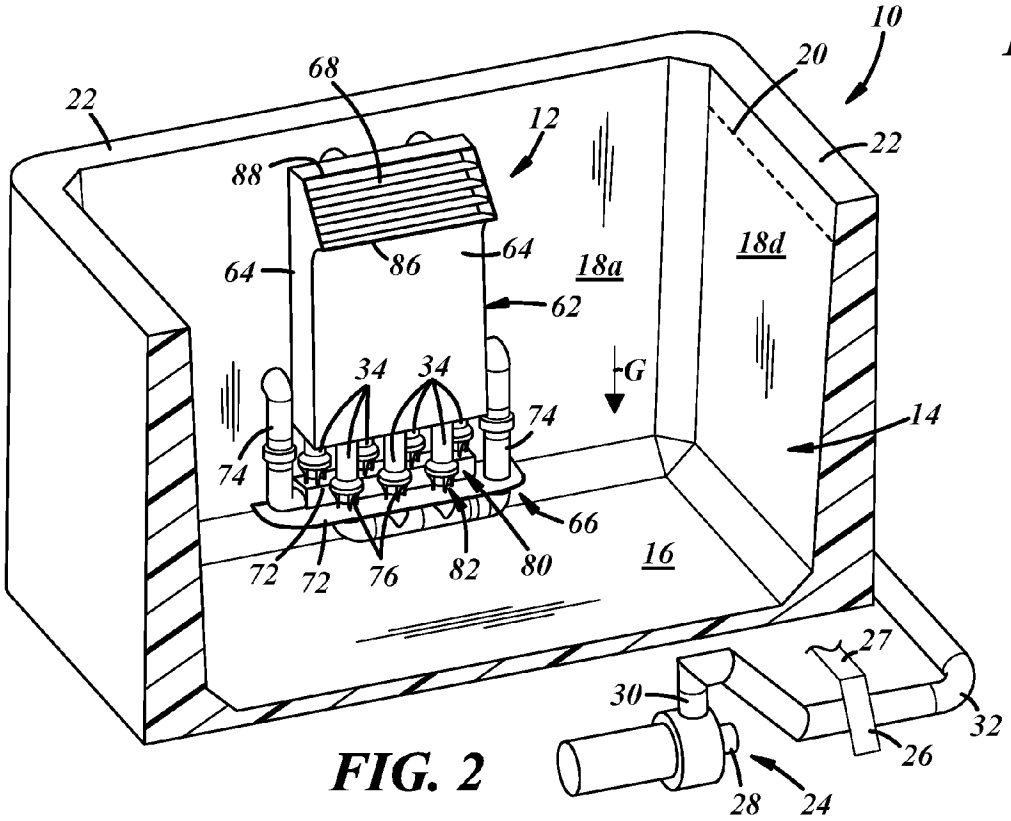
FIG. 2 is a perspective sectional view of a portion of a swim spa with part of a cover removed to show a manifold and venturi array of the current generator.

Referring in more detail to the drawings, FIGS. 1 and 2 illustrate a swim spa 10 that includes one implementation of a current generator 12. The current generator 12 creates a flow of water within the swim spa and a person may exercise against that current, for example by swimming, doing water aerobics or other activities. In at least some implementations, the current generator 12 may be integrated into a pool or swim spa when the pool or swim spa is manufactured, and in other implementations, the current generator 12 may be a separate unit adapted to be installed into an existing pool or swim spa.

In the implementations shown, the swim spa 10 includes multiple walls that generally define a main or interior volume 14 in which a liquid such as water may be contained. In more detail, the main volume 14 may be defined at least in part by a bottom wall 16 and numerous side walls 18*a-d* joined to and extending from the bottom wall 16 with a water level (the upper surface of the water, generally indicated by dashed line 20) being below an upper surface or edge 22 of the side walls 18. As used herein, terms like bottom, side, upwardly, downwardly and the like are used with reference to the direction of the Earth's gravitational force which is downward. With this reference, the side walls 18 extend upwardly from the bottom wall 16 and may but need not be perpendicular to the bottom wall. The current generator 12 may be mounted on or adjacent to a first side wall 18*a* (hereafter called a front wall) and may direct water toward an opposite side wall 18*b* (hereafter called a rear wall). The front and rear walls 18*a*, 18*b* are joined by sidewalls 18*c* and 18*d*.

As shown in FIG. 2, one or more primary pumps 24 may be used to provide the primary motive force for system water flow. The primary pump 24 (more than one may be used) may be a standard pool water pump, for example, an electrically powered centrifugal pump, and may have an output flow rate of between 100 gallons/minute and 400 gallons per minute. The output flow rate of the primary pump 24 may be adjustable to permit an adjustable current to be provided from the current generator 12. The primary pump 24 may be controlled by a controller and may be adjusted by a user, or automatically (e.g. in response to the rate at which a swimmer is swimming), or otherwise. In addition or instead, a valve 26, such as a bypass, throttle or diverter valve may be used to divert flow and control the system output in that manner. Diverted flow may be directed through spa jets into the main volume 14 (e.g. via conduit 27), back to the primary pump, or otherwise as desired. The primary pump 24 may be located outside of the main volume 14, if desired, and may be embedded within one or more of the walls 16, 18*a-d*. And the primary pump 24 may have an inlet 28 communicated with the main volume to receive water therefrom and an outlet 30 communicated with the current generator 12 to supply water under pressure to the current generator 12. The water may be routed to and from the primary pump 24 via conduits 32 or other components defining passages and the conduits/passages may be routed within the swim spa walls or outside of the walls, or both.

Figure 3:
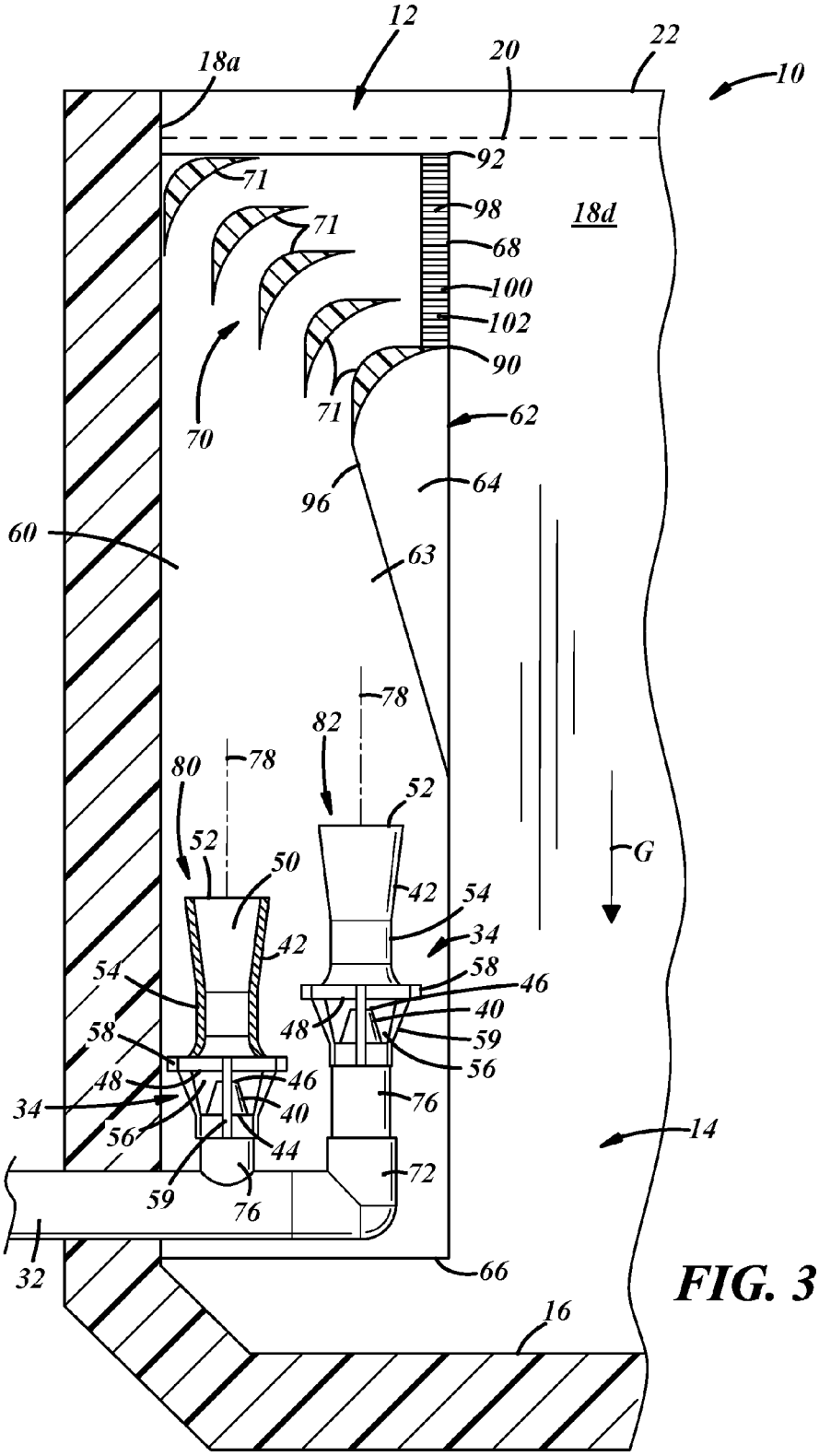
FIG. 3 is a sectional side view of the current generator illustrating a couple of entrainment pumps with a venturi of one pump shown in cross-section.

As shown in FIGS. 2 and 3, the current generator 12 may include one or more entrainment pumps, hereafter called entrainment pumps 34. The entrainment pumps 34 may be so-called jet pumps or venturi pumps and include a nozzle 40 and a venturi 42 downstream of the nozzle. As shown in FIG. 3, the nozzle 40 includes a nozzle inlet 44 that receives water from the primary pump outlet 30 and includes a nozzle outlet 46 through which water is discharged at relatively high velocity.

The venturi 42 includes an inlet 48 that leads to an internal passage 50 that terminates at an outlet 52 from which water is discharged from the venturi 42. The venturi 42 may also include a neck 54 having a diameter or flow area that is smaller than the venturi inlet 48 and may also be smaller than the venturi outlet 52. Hence, the venturi 42 may have a converging section from the inlet 48 to the neck 54 and a diverging section from the neck 54 to the venturi outlet 52. This shape or construction of the venturi 42 may improve the pumping action of the entrainment pump, but is not necessary (i.e. the passage 50 may have other shapes and need not converge or diverge). The entrainment pump 34 further includes an entrainment inlet 56 in the region of the nozzle outlet 46 and venturi inlet 48.

The entrainment inlet 56 is open to the surrounding environment which includes a volume of water when the current generator 12 is installed in a spa 10. The nozzle 40 may, in at least some implementations, be axially spaced from the inlet of the venturi 42 with a gap between them defining the entrainment inlet 56. The nozzle 40 could also be received at least partially within the passage 50, if desired. A housing 58 may be provided to retain the venturi relative to the nozzle. The entrainment inlet 56 may be defined by one or more openings in the housing 58. As shown, the housing 58 includes a plurality of arms 59 extending to a base connected to the venturi, and openings between adjacent arms define at least part of the entrainment inlet 56 which may be oriented around all or part of the circumference of the housing.

In at least some implementations, a plurality of entrainment pumps 34 are provided. As shown in FIGS. 2 and 3, to distribute water from the primary pump outlet 30 to the nozzle 40 of each entrainment pump 34, one or more manifolds 72 may be provided with an inlet 74 communicated with the primary pump outlet 30 and a plurality of outlets 76, each associated with a respective one of the nozzles 40. In FIG. 2, two manifolds 72 are shown and each supplies water to a separate row or array of entrainment pumps 34, and in FIG. 3, a single manifold 72 is shown to feed the pumps 34.

In operation, pressurized water from the primary pump 24 is fed to each nozzle 40 via the conduit 32 and manifold(s) 72. The flow of water from the nozzle outlet 46 to the venturi 42 at relatively high velocity creates a pressure drop at the entrainment inlet 56. The pressure drop causes water to flow through the entrainment inlet 56 whereupon that water flow is mixed or entrained into the water flowing out of the nozzle 40. The combined flows are directed into and through the venturi passage 50 and together exit the venturi outlet 52. From the venturi outlet 52, the water flows into a main passage 60 (FIG. 3) of the current generator 12. As shown and in at least certain implementations, the venturis 42 are fully submerged in water within the main passage 60 and are hence, fully wetted with liquid and pump primarily or only liquid. Gas, like air, may also be discharged from the nozzle (e.g. as might be provided by the primary pump). Gaseous flow through the venturis may decrease the rate of liquid entrainment, but may be acceptable or desirable in at least certain products.

The main passage 60 may be defined by any suitable structure and is shown as being defined partially by a housing 62 mounted to, integral with and/or defining part of the front wall 18*a* of the spa 10. The housing 62 may have any desired shape (a couple examples are shown in FIGS. 1-4) and may include one or more walls 64 that define at least part of the main passage 60. The housing may also include a cover 65 received over the entrainment pumps 34 to enclose them, which is shown in FIG. 1 but is removed in the example shown in FIG. 2. The main passage 60 includes an inlet 66 (which may be defined in the cover 65 or elsewhere, and usually includes or is covered by a grill) and an outlet 68 that are open to or otherwise communicated with the main volume 14 of the swim spa 10 but the main passage 60 may otherwise contain a secondary volume of water that is separated from the water in the main volume 14 of the swim spa 10. Water from the entrainment pumps 34 flows into the main volume 14 from the main passage outlet 68 and water from the main volume 14 may flow into the main passage 60 through the main passage inlet 64 to provide a volume of water available at the entrainment inlets 56 of the entrainment pumps 34. In at least some implementations, at least part of the entrainment pumps 34 may be located within the main passage 60 (as seen in FIGS. 2 and 3) so that the entrainment pumps 34 are not exposed within the main volume 14 of the swim spa 10 and so that a user or objects within the main volume do not come into direct contact with the entrainment pumps. Otherwise, the venturi outlets 52 may be arranged to direct water into the main passage 60.

Each entrainment pump 34 may be oriented such that the fluid flow out of the venturi outlets 52 is directed within the main passage 60 at least partially against the force of gravity, and the direction of the fluid is changed within the main passage before the fluid exits the main passage 60 through the main passage outlet 68. In at least some implementations, the nozzle 40 is lower than the venturi outlet 52 with respect to the direction of the force of gravity (illustrated by arrow G) and fluid is directed at least partially upward relative to gravity. In other words, the entrainment pumps 34 may be oriented generally vertically with the venturi inlet 48 positioned closer to the bottom wall 16 than the venturi outlet 52. The venturi passage 50 may be oriented parallel to the direction of the force of gravity or within 30 degrees of parallel to the direction of the force of gravity (e.g. an axis 78 (FIG. 3) of the venturi passage may be so oriented), and water flow through the venturi passage 50 may be counter to or against the force of gravity. While the venturis 42 are shown in FIG. 3 as being oriented parallel to each other, they may be oriented in different directions to provide output flows that are not parallel to each other. This may encourage and facilitate mixing of the output streams within the main passage 60 and before being discharged into the main volume 14. Further, while noted that the venturi inlet may be lower than the venturi outlet, this is not necessary and the flow out of the venturi outlet could be directly upwardly at any desired angle relative to the direction of gravitational force, such as by a surface of the housing 62.

Likewise, the main passage 60 may be oriented (e.g. defined by walls arranged) parallel to the direction of the force of gravity or within 30 degrees of parallel to the direction of the force of gravity. With the main passage inlet 66 closer to the bottom wall 16 than the main passage outlet 68, water flow through the main passage 60 also is generally counter to the direction of the force of gravity. To provide a water flow in the main volume 14 from the front wall 18*a* towards the back wall 18*b*, the main passage outlet 68 may be oriented perpendicular to the direction of the force of gravity or within 30 degrees of perpendicular to the direction of the force of gravity, and the main passage outlet 68 may be oriented near, and at least partially below, the water level 20 in the main volume 14.

Figure 4:
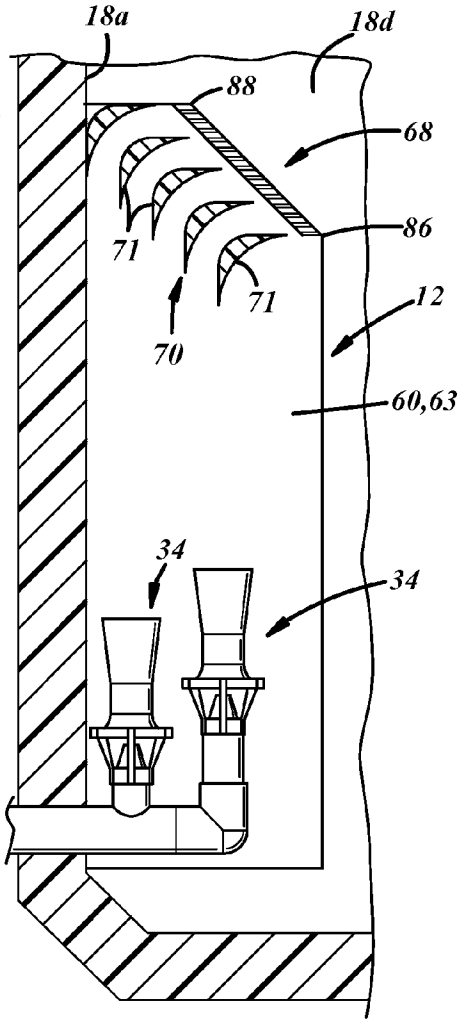
FIG. 4 is a sectional side view of a current generator like FIG. 3 with a different outlet and housing.

The outlet 68 and/or main passage 60 may also be oriented or shaped in any desired manner to create a desired water flow from the current generator 12 and into the main volume 14 of the swim spa. As shown in FIGS. 1, 2 and 4, the main passage outlet 68 may be at least partially submerged in water, and may be sloped or otherwise arranged so that a lower edge 86 protrudes further away from the front wall 18*a* than does an upper edge 88. A swimmer may experience less interference with an outlet 68 that is sloped in this manner. FIG. 3 shows an outlet that is arranged vertically, with lower and upper edges 90, 92 generally the same distance from the front wall 18*a*. FIG. 3 also illustrates a main passage 60 with a constriction 96 (caused by one or more housing walls being angled relatively to other walls) which may improve mixing of the venturi outlet streams and may increase velocity of water flow in the main passage 60.

To guide water within the main passage 60 and direct water out of the main passage outlet 68 in a desired direction and manner, one or more flow directors 70 (FIG. 3) may be provided at or upstream of the main passage outlet 68. The flow directors 70 may thus transition water flow in the main passage 60 from a first direction from the entrainment pumps 34 to a second direction generally parallel to the main passage outlet 68. In at least some implementations, the first direction may be offset from the second direction by at least 45 degrees. The flow directors 70 may include contoured wall sections 71 that lead from an area upstream of the outlet 68 to or toward the outlet 68. The flow directors 70 may be convex as viewed from the front wall 18*a*. In the area of the flow directors 70 (if any), the main passage 60 may have a substantially constant cross-sectional or flow area to reduce turbulence as the water flow direction is changed and to reduce pressure loss in that region of the main passage 60.

Further, the outlet passage 68 may be at least partially covered by a grill 98. The grill may include a plurality of smaller openings 100 that prevent intrusion of fingers other objects into the main passage 60. The openings 100 may be defined in channels 102 of the grill 98 and the channels 102 may be oriented to provide an additional directional control for the water flowing out of the main passage 60. In at least some implementations, the channels 102, openings 100 or both may be hexagonal in shape, at least one inch long (direction from front wall 18*a* to back wall 18*b*).

As shown in FIGS. 1-3, the entrainment pumps 34 are submerged in water within the spa 10, and may be fully or partially received within the main passage 60. In at least some implementations, the entrainment pumps 34 may be provided in one or more arrays. If desired, each array may be fed water from a single manifold 72, and the entrainment pumps 34 of each array may be arranged in a row or otherwise, and may be set at a uniform distance from the front wall 18*a*. In the implementation shown in FIGS. 2 and 3, two arrays 80, 82 of entrainment pumps 34 are provided with the entrainment pumps 34 of a first array 80 closer to the front wall 18*a* than the entrainment pumps 34 of a second array 82. This may provide a desired spacing of the venturi outlets 52 within the main passage to provide a desired water flow within the main passage 60. Further, the venturi outlets 52 may be provided at least one foot from the main passage outlet 68, and in some embodiments may be at least two feet beneath the water level 20 in the main volume 14 and two feet from the main passage outlet 68. Hence, the streams of water from the venturi outlets 52 of each entrainment pump 34 may become merged or mixed within the main passage 60 to provide a more uniform flow of water out of the main passage outlet 68.

Due to the vertical orientation of the venturis 42, the venturi outlets 52 may be significantly spaced from the main passage outlet 68 even with relatively long venturis 42 being used, for example venturis between 5 and 12 inches long, and even with a housing 62 or main passage 60 that protrudes minimally into the main volume 14 (e.g. minimally from the front wall 18*a*), for example less than 1.5 feet. This may enable the separate venturi output flow streams to more uniformly mix and merge together before being delivered into the main volume 14. To facilitate this, multiple ones of or all of the venturi outlets may each be open to the same space within the main passage, such that the output flows may merge rather than being maintained independent and separate. In the embodiments shown, all of the venturis open into a common and open space 63 within the main passage 60 so that the output from all venturis may merge and mix together. In at least some implementations, the common, open space 63 may be at least one foot in length and provide at least one foot of fluid travel before the main passage outlet. In some implementations, two or more feet of fluid travel in the common space 63 is provided upstream of the main passage outlet. This may provide an output flow from the main passage outlet 68 that has a more uniform velocity across the entire surface area of the outlet, rather than localized areas of much higher velocity as may occur if the venturi outlets are near the outlet and not merged before entering the main volume 14, or if the output flows from the venturis are maintained separate from each other.

In a system where the venturi outlets are arranged generally horizontally (perpendicular to the direction of gravity), to have the venturi outlets arranged two feet from an outlet to the main volume would require the venturi outlets to be horizontally spaced at least two feet from the outlet, which would consume a lot of space in a swim spa which are generally relative short and compact pools. Further, horizontal venturi outlets that are aligned with the swimmer and directed at the swimmer provide output flows from the venturis that are not caused to change direction, so mixing of the individual streams is less causing the swimmer to be impacted by localized areas of water at different velocities.

Offsetting the venturis 42 vertically from the main passage outlet 68 enables larger venturis to be used while still providing sufficient area between the venturis and the outlet 68 to permit the output streams to mix and merge. The larger venturis 42 that may be used in the swim spa 10 can provide greater rates of water entrainment and higher output flow rates from the entrainment pumps 34 to provide a more efficient generation of relatively strong currents in the spa 10, while still providing a relatively uniform velocity of the output into the main volume 14. In at least one example, nine-inch venturis 42 are used and achieve entrainment flow rates up to four times the flow rate of water out of the nozzles 40 so the total flow rate out of the venturi outlet 52 is five times that of the nozzle 40. In one example, a 16-amp, 240 volt primary pump 24 provided an output flow rate of 340 gallons per minute at a pressure of about 10 psi, and that water was fed to 8 entrainment pumps 34 that entrained water at a rate of 1,360 gallons per minute and provided an output from the main passage outlet 68 of about 1,700 gallons per minute.

In view of the relatively high rate of entrainment, the entrainment pumps 34, and particularly the entrainment inlets 56 of two or more pumps, may be provided at different heights (e.g. different distances from the bottom wall 16). This prevents all of the entrainment pumps 34 from drawing water at the same level which may reduce the efficiency of the pumps 34 (e.g. if make-up water flow is slower than the entrainment possible at any of the pumps). Further, to facilitate water flow to the entrainment pumps 34 that are inboard or closer to the front wall 18*a*, the entrainment inlets 56 of the pumps 34 closer to the front wall 18*a* may be positioned closer to the bottom wall 16 than the entrainment inlets 56 of the pumps 34 farther from the front wall 18*a*. Of course, other arrangements may be used, for example but not limited to, an arrangement wherein the entrainment inlets 56 are staggered at various heights along an array or among multiple arrays, or where at least one entrainment inlet is at a different height than at least one other entrainment inlet.

Figure 5:
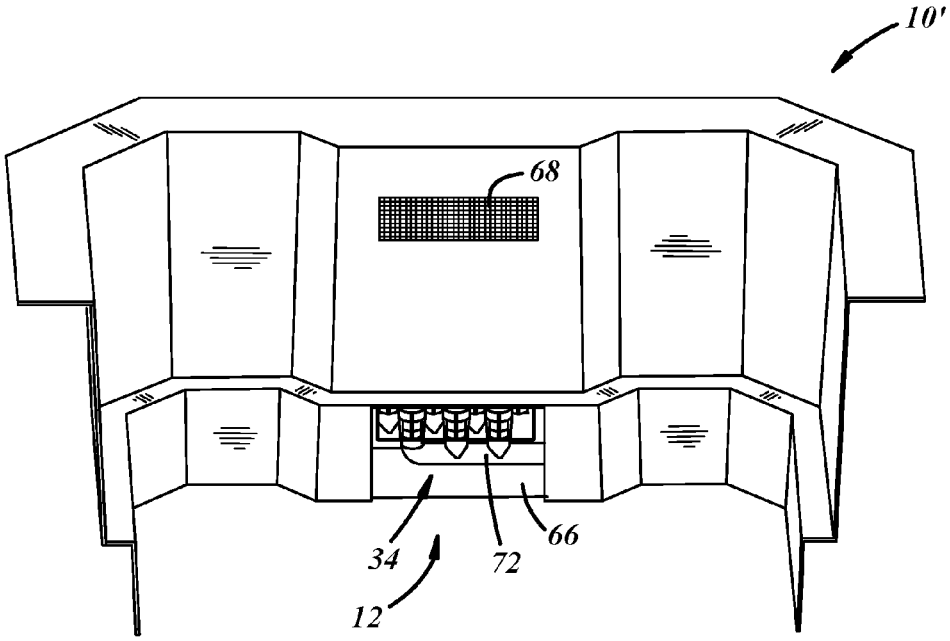
FIG. 5 is a perspective front view of a portion of a swim spa with a current generator integrated into a front wall of the spa.
Figure 6:
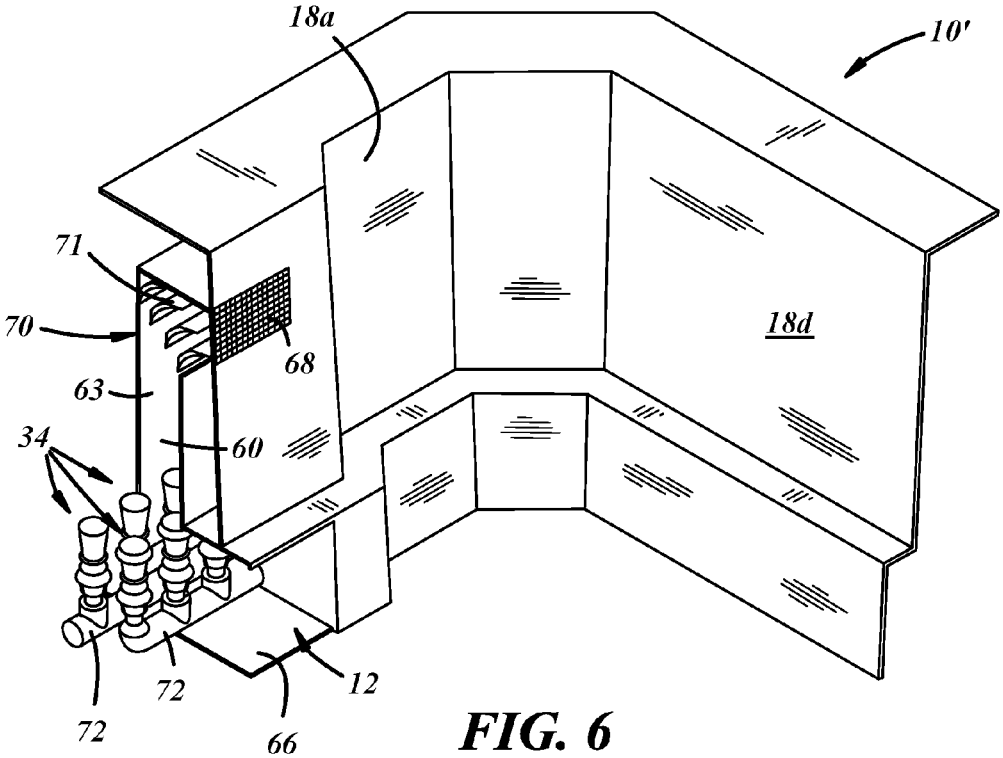
FIG. 6 is a perspective and sectional view of a portion of the swim spa of FIG. 5.

While shown and described above with a housing 62 that defines at least part of the main passage 60 and protrudes outwardly from the front wall 18*a*, the current generator 12 (e.g. the entrainment pumps 34 and main passage 60) may be located outside of the main volume 14, and within the front wall 18*a* or otherwise behind an inside surface of the front wall, as generally shown in FIGS. 5 and 6. In this way, the current generator 12 does not protrude at all from the front wall 18*a*. The spa 10' of FIGS. 5 and 6 may be constructed and arranged substantially as shown in FIGS. 1-4, and in that regard, the same reference numbers have been provided to the same or similar components shown in these views.

Where a housing 62 protruding from the front wall 18*a* is used, it may be covered in a skin 104 (FIG. 1) of any suitable material, such as, but not limited to, a thermoformed polymeric skin that may be adhered to or otherwise integrated with the front wall, if desired. The current generator 12 could also be portable in the sense that it may be removable from the spa 10, and the current generator 12 may be sold as a separate unit that may be integrated into existing spas, if desired.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A current generator for a swimming system having a main volume for a swimmer and a main passage in which water flows from the current generator to an outlet of the main passage leading to the main volume, comprising:

multiple entrainment pumps, each having:

a nozzle having a nozzle inlet adapted to receive a supply of pressurized fluid and a nozzle outlet, a venturi having a passage aligned with the nozzle and through which liquid discharged from the nozzle outlet flows, the venturi having a venturi outlet from which fluid flows out of the venturi passage, and an entrainment inlet open to the area outboard of manifold and communicating with the venturi passage, wherein the flow of liquid from the nozzle outlet into the venturi creates a pressure drop at the entrainment inlet and fluid in the area of the entrainment inlet is drawn through the entrainment inlet and entrained with the liquid in the venturi to flow through the venturi and out of the venturi outlet, each entrainment pump being arranged such that the fluid that flows out of the venturi passage is directed within the main passage at least partially against the force of gravity before that fluid is directed out of the main passage outlet and into the main volume.

2. The current generator of claim 1 wherein the nozzle is lower than the venturi outlet with respect to the direction of the force of gravity.

3. The current generator of claim 1 wherein venturi outlets provide at least one foot of travel of the fluid against the force of gravity within the main passage.

4. The current generator of claim 2 wherein each venturi includes a passage oriented parallel to the direction of the force of gravity or within 45 degrees of parallel to the direction of the force of gravity.

5. The current generator of claim 4 which includes a housing defining at least part of the main passage and wherein the housing includes a flow director provided in the main passage to transition the flow from a first direction from the entrainment pumps to a second direction generally parallel to the main passage outlet.

6. The current generator of claim 1 wherein the entrainment inlet of at least one entrainment pump is located at a different height than the entrainment inlet of another entrainment pump.

7. The current generator of claim 1 wherein the entrainment pumps include at least two arrays of entrainment pumps and wherein the entrainment inlets of a first array of entrainment pumps are located at a different height than the entrainment inlets of a second array of entrainment pumps.

8. The current generator of claim 7 wherein the first array is located at an inboard side adapted to be located nearer a supply of liquid in a pool with which the current generator is used and the second array is located further from the supply of liquid than the first array, and wherein the entrainment inlets of the first array are located higher than the entrainment inlets of the second array.

9. A swimming system, comprising:

a pool including a main volume adapted to contain a liquid, and a main passage having an outlet leading to the main volume;

a primary pump having an outlet from which liquid is discharged under pressure;

a manifold having at least one inlet communicated with the primary pump outlet and multiple outlets from which the pressurized liquid is discharged;

multiple entrainment pumps associated with the manifold with one entrainment pump provided for each outlet, each entrainment pump having:

a nozzle having a nozzle inlet communicating with and receiving pressurized liquid from a respective one of the manifold outlets and a nozzle outlet, a venturi having a passage aligned with the nozzle and through which liquid discharged from the nozzle outlet flows, the venturi having a venturi outlet from which fluid flows out of the venturi passage, and an entrainment inlet open to the area outboard of the manifold and communicating with the venturi passage, wherein the flow of liquid from the nozzle outlet into the venturi creates a pressure drop at the entrainment inlet and fluid in the area of the entrainment inlet is drawn through the entrainment inlet and entrained with the liquid in the venturi to flow through the venturi and out of the venturi outlet, each entrainment pump being arranged so that fluid that flows out of the venturi passage is directed within the main passage at least partially against the force of gravity and the direction of the fluid is changed within the main passage before the fluid exits the main passage through the main passage outlet.

10. The system of claim 9 wherein the entrainment pumps are arranged so that the nozzle is lower than the venturi outlet with respect to the direction of the force of gravity.

11. The system of claim 9 wherein the main passage includes an inlet through which liquid from the supply of liquid in the pool may enter the main passage, and wherein the entrainment pumps are at least partially received within the main passage.

12. The system of claim 9 wherein each venturi includes a passage along an axis and the axis is oriented parallel to the direction of the force of gravity or within 30 degrees of parallel to the direction of the force of gravity.

13. The system of claim 10 wherein the venturi outlets are arranged at least one foot from the main passage outlet.

14. The system of claim 10 wherein the main passage outlet is oriented perpendicular to the direction of the force of gravity or within 30 degrees of perpendicular to the direction of the force of gravity.

15. The system of claim 14 which also includes at least one flow director within the passage and arranged to transition the flow from a first direction from the entrainment pumps to a second direction generally parallel to the main passage outlet.

16. The system of claim 9 wherein the entrainment inlet of at least one entrainment pump is located at a different height than the entrainment inlet of another entrainment pump.

17. The system of claim 16 wherein a first entrainment pump is located at an inboard side of the main passage nearer the main volume and at least one entrainment pump is located further from the main volume than the first entrainment pump, and wherein the entrainment inlet of the first entrainment pump is located higher than the entrainment inlet of the second entrainment pump.

18. The system of claim 9 which also includes a valve located between the primary pump and the entrainment pumps to reduce the flow rate of liquid delivered to the entrainment pumps.

19. A current generator for a swimming system, comprising:

a housing defining a main passage including an open space in communication with a main passage outlet;

multiple entrainment pumps each entrainment pump having a nozzle with a nozzle outlet, a venturi having a passage through which liquid discharged from the nozzle outlet flows, the venturi having a venturi outlet from which fluid flows out of the venturi passage, and an entrainment inlet communicating with the venturi passage, wherein the flow of liquid from the nozzle outlet into and through the venturi passage creates a pressure drop at the entrainment inlet to draw in fluid in the area of the entrainment inlet and entrains the drawn in fluid with the liquid flowing through the venturi passage, the entrainment pumps being arranged so that fluid flowing out of multiple venturi passages flows into the open space of the main passage so that the fluid flows out of said multiple venturis may at least partially merger before flowing through the main passage outlet.

20. The current generator of claim 19 wherein the open space is upstream of a flow director received in the main passage and arranged to change the direction of fluid flow within the main passage before the fluid exits the main passage outlet.

21. The current generator of claim 20 wherein at least a portion of the main passage is arranged for fluid flow therein in a direction opposite to the direction of the force of gravity or within 45 degrees of being opposite to the direction of the force of gravity.

22. The current generator of claim 19 wherein the venturi outlets of said multiple entrainment pumps are arranged to discharge fluid into the main passage at least one foot from the main passage outlet.

* * * * *